US006546937B2

(12) United States Patent
Gueret

(10) Patent No.: US 6,546,937 B2
(45) Date of Patent: Apr. 15, 2003

(54) APPLICATOR, SYSTEM, AND METHOD OF PRODUCT APPLICATION

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 51 days.

(21) Appl. No.: 09/813,002

(22) Filed: Mar. 21, 2001

(65) Prior Publication Data

US 2001/0037815 A1 Nov. 8, 2001

Related U.S. Application Data

(63) Continuation-in-part of application No. PCT/FR00/01437, filed on May 26, 2000.

(30) Foreign Application Priority Data

Jul. 21, 1999 (FR) ..... 99/09451

(51) Int. Cl.[7] ..... A45D 40/26
(52) U.S. Cl. ..... 132/218
(58) Field of Search ..... 132/218, 120, 132/142, 162, 901; 15/110; 401/122, 126, 129

(56) References Cited

U.S. PATENT DOCUMENTS

997 A * 11/1838 Sanford ..... 132/142
155,977 A 10/1874 Rogers (List continued on next page.)

FOREIGN PATENT DOCUMENTS

| | | |
|---|---|---|
| DE | 25 59 273 | 7/1977 |
| EP | 0 038 524 | 10/1981 |
| EP | 0 474 934 | 3/1992 |
| FR | 1 531 835 | 5/1968 |
| FR | 2 564 712 | 11/1985 |
| FR | 2 748 636 | 11/1997 |
| GB | 2 146 520 | 4/1985 |
| GB | 2 159 699 | 12/1985 |
| JP | 7-322915 | 12/1995 |
| JP | 9-108033 | 4/1997 |
| JP | 10-215944 | 8/1998 |
| WO | WO 95/17837 | 7/1995 |
| WO | WO 97/28719 | 8/1997 |

OTHER PUBLICATIONS

Co–pending Application No. 09/621,903; Attorney Docket No. 08048.0001–00000 Title: Applicator, Applicator System, and Method for Applying a Product to the Eyelashes Inventor(s): Jean–Louise H. Gueret Filed: Jul. 21, 2000.
Co–pending Application No. 09/621,901; Attorney Docket No. 08048.0002–00000 Title: Eyelash Product Applicator, Applicator System, and Method Inventor(s): Jean–Louis H. Gueret Filed: Jul. 21, 2000.

(List continued on next page.)

*Primary Examiner*—Todd E. Manahan
(74) *Attorney, Agent, or Firm*—Finnegan, Henderson, Farabow, Garrett & Dunner, L.L.P.

(57) ABSTRACT

An applicator includes an application element configured to apply a product to eyelashes and/or eyebrows. The application element includes a support, and at least two rows of teeth. The rows of teeth are disposed transversely with respect to the longitudinal axis of the support. Each of the rows of teeth comprises at least two teeth extending from the support. The rows of teeth comprise a first row of teeth adjacent to a second row of teeth. The first row of teeth and the second row of teeth are spaced apart by a first distance. A pair of consecutive teeth of the first row of teeth are spaced apart by a second distance less than the first distance. An applicator system includes the applicator in combination with a receptacle for containing the product. Also provided is a cosmetic application method using the applicator.

87 Claims, 3 Drawing Sheets

U.S. PATENT DOCUMENTS 466,496 A 1/1892 Heysinger
791,690 A 6/1905 Grell
819,444 A * 5/1906 Monroe ..... 132/120
1,094,013 A 4/1914 Peterson
1,130,574 A * 3/1915 Corley ..... 132/142
1,580,365 A 4/1926 Bechtold
1,670,161 A 5/1928 Meyer
1,780,206 A 11/1930 McKellar
1,829,228 A 10/1931 Lewis
1,892,749 A 1/1933 Philaja
1,963,389 A 6/1934 Vardeman
1,989,185 A 1/1935 Clein
2,175,344 A 10/1939 Friedman
2,255,618 A 9/1941 Huppert
2,264,346 A 12/1941 Tupper
2,348,339 A 5/1944 Golden
2,395,002 A 2/1946 Kemmer
2,569,246 A 9/1951 Marcellus
2,596,296 A 5/1952 Shields
2,626,618 A 1/1953 Collison
2,655,925 A 10/1953 Ulvad
3,312,583 A 4/1967 Rochlis
3,669,130 A 6/1972 Petroczky
3,763,870 A 10/1973 Montgomery et al.
3,862,639 A 1/1975 Schefer et al.
3,892,248 A 7/1975 Kingsford
3,921,650 A 11/1975 Montgomery
3,930,280 A 1/1976 Vasas
4,403,624 A 9/1983 Montgomery
4,422,986 A 12/1983 Cole
4,561,456 A 12/1985 Gueret
4,565,205 A 1/1986 Taylor
4,635,659 A 1/1987 Spatz
4,660,582 A 4/1987 Taylor
4,712,936 A 12/1987 Kessler
4,744,377 A 5/1988 Dolan, Jr.
4,804,004 A 2/1989 Taylor
4,964,429 A * 10/1990 Cole ..... 132/218
5,007,442 A 4/1991 Hirzel
5,046,213 A 9/1991 Curtis et al.
5,086,793 A 2/1992 Kingsford
5,137,387 A 8/1992 Byrd et al.
5,370,141 A * 12/1994 Gueret ..... 132/218
5,462,798 A * 10/1995 Gueret ..... 132/218
5,918,994 A 7/1999 Gueret
5,951,185 A 9/1999 Kingsford et al.
6,053,179 A 4/2000 Lhuisset

OTHER PUBLICATIONS

Co–pending Application No. 09/621,680; Attorney Docket No. 08048.0003–00000 Title: Product Applicator, Applicator System, and Application Method for the Eyelashes Inventor(s): Jean–Louis H. Gueret Filed: Jul. 21, 2000.

Co–pending Application No. 09/624,004; Attorney Docket No. 08048.0004–00000 Title: Product Applicator, Applicator System, and Method of Application for Eyelashes Inventor(s): Jean–Louis H. Gueret Filed: Jul. 21, 2000.

Co–pending Application No. 09/813,004; Attorney Docket No. 08048.0005–00000 Title: Angled Tooth Applicator, System, and Method of Product Application Inventor(s): Jean–Louis H. Gueret Filed: Mar. 21, 2001.

Co–pending Application No. 09/813,003; Attorney Docket No. 08048.0007–00000 Title: Applicator System and MEthod Inventor(s) Jean–Louise H. Gueret Filed: Mar. 21, 2001.

* cited by examiner

APPLICATOR, SYSTEM, AND METHOD OF PRODUCT APPLICATION

This application is a continuation-in-part (CIP) of copending PCT international application No. PCT/FR00/01437, filed May 26, 2000, which claims the benefit of priority of French Application No. 99/09451, filed Jul. 21, 1999.

The present invention pertains to applicators, and methods of using such applicators, for applying a product. In particular, the present invention is directed to an applicator for the application of a product, such as a cosmetic product or a care product, for example, to the eyelashes, eyebrows, or other types of hair. The invention also relates to an applicator system including the applicator and a receptacle for containing the product to be applied.

European Patent Application EP-A-0 474 934 discloses a brush for applying mascara to eyelashes. The brush includes a circularly-symmetrical cylindrical body and brush members aligned parallel to the longitudinal axis of the brush. The brush members have circular cross-sections and are offset relative to one another in the longitudinal direction.

German Patent Application DE-A-2 559 273 also discloses a brush for applying mascara. The brush includes a hollow, circularly-symmetrical cylindrical body and brush members aligned parallel to the longitudinal axis of the brush. The brush members have triangular cross-sections. Long sides of the triangular cross-sections are parallel to the longitudinal axis of the support.

European Patent Application EP-A-0 204 466 also discloses a brush for applying mascara. The brush has brush members aligned parallel to the longitudinal axis of the support.

French Patent Application FR-A-2 564 712 discloses an applicator having two arrangements of teeth aligned parallel to one another. The teeth have bases with triangular shaped cross-sections. A short side of each triangle shape is parallel to axes of alignment of the teeth. A height of the triangle shape, extending from the opposite vertex, is perpendicular to the axes of alignment.

French Patent Application FR-A-2 748 636 discloses a mascara applicator including thin teeth arranged parallel to the longitudinal axis of the applicator.

It would be desirable if such known devices could be further improved to be capable of taking up a relatively large quantity of substance and thereby provide satisfactory endurance between refills. It would also be desirable if such devices could be improved to engage hairs, in particular the eyelashes, so as to smooth the substance over their surfaces and to lengthen them.

One aspect of the present invention relates to an applicator for applying a product to at least eyelashes and/or eyebrows. The applicator comprises an application element configured to apply a product to at least the eyelashes and/or eyebrows. The application element comprises a support and at least two rows of teeth. The rows of teeth may be disposed transversely with respect to the longitudinal axis of the support. Each of the rows of teeth comprises at least two teeth extending from the support. The rows of teeth comprise a first row of teeth adjacent to a second row of teeth. The first row of teeth and the second row of teeth may be spaced apart by a first distance. A pair of consecutive teeth of the first row of teeth may be spaced apart by a second distance less than the first distance.

The applicator may have rows of teeth on one side portion of the applicator essentially forming a comb. Alternatively, the applicator may have rows of teeth disposed in various portions around the applicator, essentially forming a brush. For example, the applicator may include one set of rows of teeth disposed on one side of the applicator and another set of teeth rows on an opposite side of the applicator.

In one optional configuration, the distance between any pair of consecutive teeth of any of the at least two rows is less than the distance between the row including the pair and a row adjacent thereto.

In another optional arrangement, each of the teeth extending from the support is arranged in a row disposed (e.g., axis of the row) transversely to the longitudinal axis of the support. The row of teeth may cross the longitudinal axis of the support or may be located on one side thereof.

In one other optional arrangement, an axis of at least one row forms a non-zero acute angle with the longitudinal axis of the support. For example, the axis of each of the at least two rows may form a non-zero acute angle with the longitudinal axis of the support. This angle formed by each row could be substantially the same.

As used herein, the term "axis of the row" refers to the axis along which the teeth in a row are arranged. For example, the axis of the row could be substantially straight or curved. The teeth in the row may be a succession of consecutive teeth.

Optionally, the arrangement of the teeth enables the applicator to take up a quantity of substance that is sufficiently large. The tooth arrangement optionally also enables the teeth to engage hairs, in particular the eyelashes, while the application element is being moved relative thereto, in a direction perpendicular to the longitudinal axis of the support. For example, an applicator according to the invention may make it possible to have a relatively large quantity of substance between the teeth while spreading the substance onto the eyelash surface, without the teeth losing their capacity to engage with and curve an eyelash.

In one aspect, base portions of at least one pair of consecutive teeth in at least one row may either contact one another or lack contact with one another. As used herein, the term "base portion" refers to the portion of a tooth adjacent to the support (i.e., opposite to the free end portion of the tooth).

One or more of the teeth in the row optionally have an oblong cross-section. There are many different possible shapes for the oblong cross-section of the base. In one possible embodiment, the oblong cross-section may have a substantially rectangular shape. In other examples, the oblong cross-section may be substantially in the shape of an oval, an ellipse, or a triangle.

The oblong cross-section may be angularly positioned in a direction forming a nonzero acute angle with the longitudinal axis of the support. As used herein, the "direction" of the angular positioned oblong cross-section refers to the direction in which a longitudinal axis of the oblong cross-section is arranged. For example, when the oblong cross-section is substantially rectangular shaped, the direction of such a cross-section may correspond to the longitudinal axis parallel to the two longer sides of the rectangular shape. As another example, when the cross-section is substantially in the shape of an ellipse, the direction would correspond to a major axis of the ellipse.

In one embodiment, each of the at least two rows includes a first end and a second end, wherein the first end may be aligned along a first axis and the second end may be aligned along a second axis, and wherein the first and second axes may be parallel to the longitudinal axis of the support. These first and second axes may be on opposites sides of the support.

In another aspect, at least a pair of consecutive teeth in the same row and/or a pair of adjacent teeth from a pair of adjacent rows (e.g., a first tooth from a first row and a second tooth from a second row adjacent to the first) may be mutually overlapping when the application element is observed from the side, in a direction perpendicular to the longitudinal axis of the support. Optionally, the overlapping teeth may form a substantially V-shaped notch therebetween, and the notch may be configured such that a hair is capable of being engaged therein. For example, the bottom of the notch may be situated at a non-zero distance from the support.

The profile of the above-mentioned V-shaped notch may converge towards the support. The notch may be configured so that substance present between the teeth may be spread in a satisfactory manner over the surface of the hair engaged in the notch, all the way to the end of the hair.

In another aspect, the rows of teeth may be disposed on the support such that a projection along an axis of the first row does not substantially overlap a projection along an axis of the second row.

In another aspect, the at least two rows of teeth may comprise a first group of rows angularly positioned in a direction parallel to a first axis, and a second group of rows angularly positioned in a direction parallel to a second axis, the second axis not being substantially parallel to the first axis. The first and second axes may be angularly positioned symmetrically relative to one other. The first and second axes may be angularly positioned about a plane of symmetry perpendicular to the longitudinal axis of the support. The first group of rows may be formed at a first end of the support and the second group of rows may be formed at a second end of the support.

In another aspect, base portions of the teeth may be arranged along an axis having a shape chosen from a substantially straight shape and a curved shape.

In one embodiment, the base portions may be rectangular in cross-section, and a long side of each rectangular cross-section may be substantially parallel to an axis of the corresponding row.

In another aspect, one or more teeth may have a tapered cross-section extending over at least a portion of the tooth height from adjacent the support toward a tooth free end.

In still another aspect, at least some of the teeth may have a free end portion having a shape chosen from cylindrical, substantially cylindrical, and curved.

In one embodiment, a tuft of bristles may be mounted on the support. For example, the tuft may be along the row of teeth.

Optionally, at least the support and the teeth are an integral, one-piece arrangement. For example, the application element may be formed by molding, die stamping, or any other method of shaping material.

In a further aspect, one or more of the teeth may comprise a gliding agent for improving gliding of the hair on the teeth. The gliding agent may be chosen from polytetrafluoroethylene, graphite, silicones, molybdenum disulfide, and derivatives thereof. The gliding agent could either be a coating on an exterior surface of the teeth or a filler incorporated in plastic material of the teeth. For example, the teeth could be formed by molding plastic material containing the gliding agent. The gliding agent may prevent hair from being gripped too strongly by the teeth, and thereby improve application comfort.

In an even further aspect, the application element may be formed of a material chosen from elastomer, metal, and alloy.

In yet a further aspect, the application element may have a first end and a second end opposite to the first end (e.g., front and rear ends), wherein a number of the teeth between the first end and the second end may range from about 20 to about 50. Alternatively, the number of teeth may range from about 6 to about 50, or from about 10 to about 35, or from about 15 to about 32.

The teeth may be made of either the same material as the support or a different material. The height of the teeth may vary. The height of each of the teeth may range from about 0.5 mm to about 15 mm. Alternatively, the height of each of the teeth may range from about 0.5 mm to about 10 mm. Alternatively, the height of the teeth may range from about 7 mm to about 13 mm.

In yet another aspect, at least one of the rows of teeth may comprise teeth having bases offset in alternation, at least in part, on either side of a geometrical separation plane containing the axis of the row.

In one example, the above-mentioned angle formed by the direction of the cross-section and the longitudinal axis of the support and/or the above-mentioned angle between the at least one of the rows and the longitudinal axis of the support is less than or equal to about 45°.

In one more aspect, the support may have a polygonal cross-section in a plane perpendicular to the longitudinal axis of the support, and the application element may further comprise sets of rows of teeth, each on a different main face of the support.

In one optional arrangement, a stem (e.g., wand) may be provided with the application element being on an end of the stem. The stem may extend from a handle element configured in the form of a closure cap for closing a receptacle. The application element may be integrally molded with the stem.

The application element can be disposed on a distal end portion of the stem. The application element may be made more flexible than the stem. For example, the application element may be made of a plastic having greater flexibility than a plastic used to make the stem. Greater comfort may be obtained when using such an applicator.

As an alternative, the stem may be more flexible than the application element. For example, the stem may be made of a plastic that is more flexible than the material used to make the application element. It is possible, for manufacturing reasons, to use a relatively inflexible material to make the application element and to compensate for the inflexibility of the application element at the time of application, using the flexibility of the stem.

The longitudinal axis of the support and the longitudinal axis of the stem may be parallel or form a non-zero angle.

The applicator may be part of a system including a receptacle configured to contain the product. A cosmetic product, such as mascara for example, may be contained in the receptacle. The receptacle may include an opening configured to permit passage of at least a part of the application element into the receptacle. The receptacle may have a wiper configured to remove excess product from the teeth of the application element when the applicator is removed from the receptacle. The wiper may be deformable, and may include a block of open-cell foam or an elastomeric lip, or other similar suitable configurations.

The system also may include a cap disposed on an end of the stem opposite to the end of the stem at which the application element is disposed. The cap may be configured to sealably close the opening of the receptacle.

The application element may be produced by molding plastic as a single piece with the applicator stem and with a sealing member configured to seal the receptacle closed when it is not in use. The sealing member may have a surface shaped to fit in a sealed manner into the neck of the receptacle.

There are many different types of receptacles that could be used with the applicator system. For example, the product could be stored in a tube-like receptacle. This tube may be made of a flexible material which when squeezed can dispense product onto the application element of the applicator device. Other dispensers also can be used to dispense the product onto the application element, such as a pump-type dispenser, for example, and are considered within the scope of the invention.

Alternatively, the receptacle could be configured to hold a solid cake of the product. This solid cake could be moistened in order to enable the applicator device to be loaded with product by placing the application element in contact with the moistened part of the product. Alternatively, the application element could be moistened and then placed in contact with the product to transfer moisture to the product.

When the product is contained in either a dispenser or a cake arrangement, the proximal end of the applicator device may lack a handle or a cap, since the applicator device can be arranged such that it is not stored in the receptacle containing the product or closing off such a receptacle. In such an arrangement, the stem itself can be used as a handle.

Another aspect of the invention includes a method of applying a product to the eyelashes using an applicator or system as described in the preceding paragraphs. The method includes loading a product on at least some of the teeth and placing at least some of the teeth in contact with the eyelashes such that the product coats the eyelashes. The loading may include inserting at least a portion of the applicator into a receptacle containing the product, removing the applicator from the receptacle, and wiping the excess product from the teeth, for example, with a wiper. The loading alternatively may include either dispensing the product from the receptacle onto the teeth or contacting the teeth with a solid cake of product. The solid cake of product may be moistened and the teeth may be placed in contact with the moistened cake of product. In the latter form of loading, the moistening of the product may include either moistening the product and then contacting the teeth with the product or moistening the product with a pre-moistened applicator.

The method may optionally comprise gripping the eyelashes between adjacent teeth.

In one example of a method according to the invention, the product being applied is mascara. If the mascara includes fibers, the method may further include orienting the fibers with the teeth such that the fibers are substantially parallel to the eyelashes as the product is applied.

The applicator of the invention, as described above, may be used for applying a cosmetic product, such as mascara, to the eyelashes. However, the applicator could be used to apply other products to other surfaces. In addition, the applicator according to the present invention could also be used to comb the eyelashes or eyebrows, for example.

The application element and stem could be configured to permit connection and disconnection of the application element from the stem. With such a structural configuration, the method may further comprise connecting the application element to the stem. The method may also comprise selecting the application element from a group of differing application elements.

Aside from the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of aspects of the invention and are incorporated in and constitute a part of this specification. The drawings illustrate embodiments of the invention and, together with the description, serve to explain some of the principles of the invention.

In the drawings.

Reference will now be made in detail to some embodiments of the invention, examples of which are illustrated in the accompanying drawings. Wherever possible, the same reference numbers are used in the drawings and the description to refer to the same or like parts.

Figure 1:
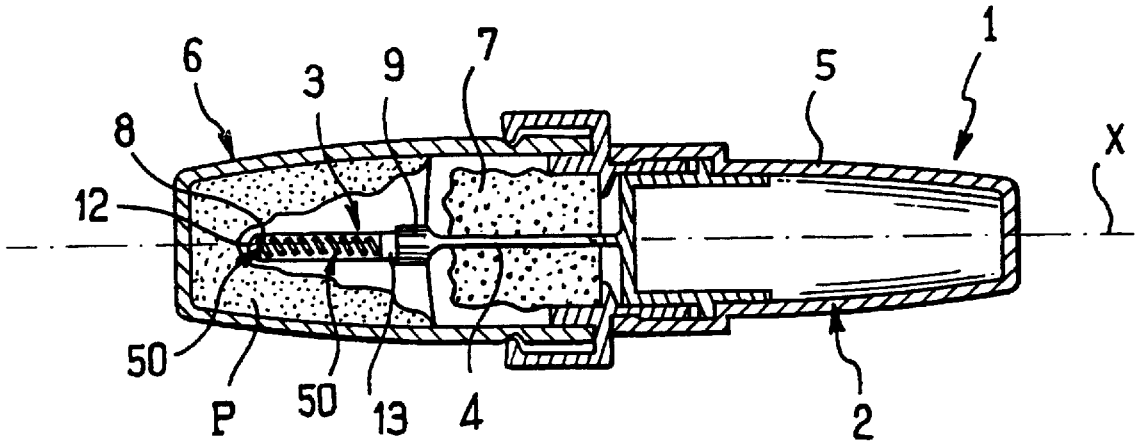
FIG. 1 is a diagrammatic axial cross-section view of an embodiment of an applicator system in accordance with the invention.

An applicator system 1 according to an aspect of the present invention is shown in FIG. 1. The applicator system 1 includes a receptacle 6 containing a product P, for example, a cosmetic product such as mascara, and an applicator 2. Applicator 2 includes a stem 4 having a longitudinal axis. An elongated application element 3 is disposed on one end of the stem 4 and a handle or grasping element 5 is disposed at an opposite end. Handle or grasping element 5 may be in the form of a cap for closing the receptacle 6.

Figure 2:
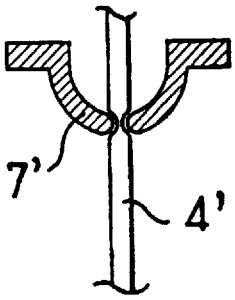
FIG. 2 is a diagrammatic section view showing a variant embodiment of a wiper member for the system of FIG. 1.

The receptacle 6 may include a wiper 7 configured to wipe the application element 3 as it is withdrawn from the receptacle 6. Wiper 7 may be made of a block of open-cell foam, as shown in FIG. 1, or an elastomeric material, or other similar suitable material. Other types of wipers may be used, such as, for example, a flexible lip 7' as shown in FIG. 2, which is optionally made of an elastomer and/or flocked. The wiper may be configured such that it flexes or deforms to the shape of the application element 3 as it passes through the wiper. If the system includes the alternative wiper 7' shown in FIG. 2, the stem may be provided with a necked-down region 4' (as compared to the remainder of the stem) that comes level with the edge of the lip 7' when the applicator is in place in the receptacle.

If the receptacle 6 is not in use, it may be sealed closed, for example by providing a sealing member on the grasping element 5 or, alternatively, on the stem 4.

As shown in FIG. 1, the application element 3 may be essentially in the form of a comb including rows of teeth 50 extending from an elongated support 8 having a longitudinal axis X, which may be substantially parallel to, or angled with respect to, the longitudinal axis of the stem 4. In the example of FIG. 1, the longitudinal axis X of the support 8 is coincident with the longitudinal axis of the stem 4. When the longitudinal axis of the support 8 and the longitudinal axis of the stem 4 are angled, the applicator may be more ergonomic.

The support 8 may have a front portion 12 and a rear portion 13 that are shaped to make it easier for the support to pass through the wiper 7 during insertion into the receptacle and removal therefrom. For example, the front and rear portions 12 and 13 may be tapered.

The rear portion 13 may be connected to an endpiece configured to be fixed in a recess formed in the end 9 of the stem 4. The endpiece could be removably connected to the stem 4 so that the application element 3 could be separated from the stem 4, or, alternatively, the application element 3 and stem 4 could be coupled to one another without enabling removal of the application element 3. When the application element 3 is removably connected, a differently configured application element could be substituted in place of the existing application element.

Figure 3:
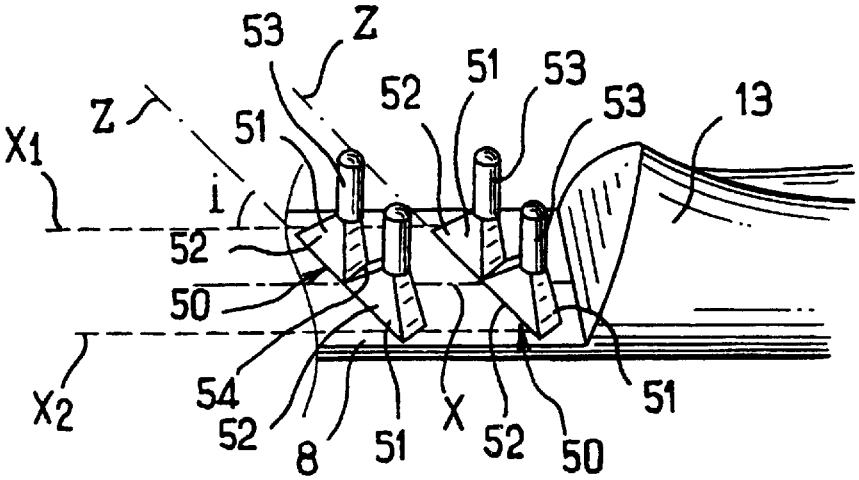
FIG. 3 is a diagrammatic fragmentary view of a first embodiment of an application element for the system shown in FIG. 1.
Figure 4:
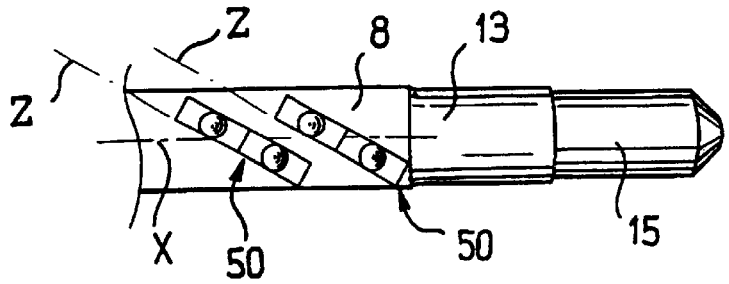
FIG. 4 is a fragmentary plan view of the application element of FIG. 3.

FIGS. 3 and 4 are fragmentary views of the application element 3, with only two teeth rows 50 being shown, for ease of illustration. Each row 50 may be made up of two teeth 51. Each of the teeth 51 may have a base 52 of rectangular cross-section, wherein long sides of the rectangle extend parallel to an axis Z that is not perpendicular to the axis X and that forms a non-zero acute angle i with the longitudinal axis X. When they are observed from the side in a direction perpendicular to the axis Z, each of the bases 52 may have a triangular profile, and may be positioned under a body 53 or spike that is substantially cylindrical.

In the example shown in FIGS. 3 and 4, the bases 52 of the teeth 51 in the same row 50 are mutually touching, and two consecutive teeth 51 form a notch 54 between them, as shown in FIG. 3. The rows 50 may have first ends that are aligned along an axis $X_1$ parallel to the axis X, and second ends aligned along an axis $X_2$ parallel to the axis X, and situated on the opposite side of the axis X from the axis $X_1$.

The distance between consecutive rows 50 may be larger than the spacing between the bases of the teeth within each row. In the example shown in FIGS. 3 and 4, the spacing between bases of the teeth in each row is zero, since the bases are mutually touching.

Figure 5:
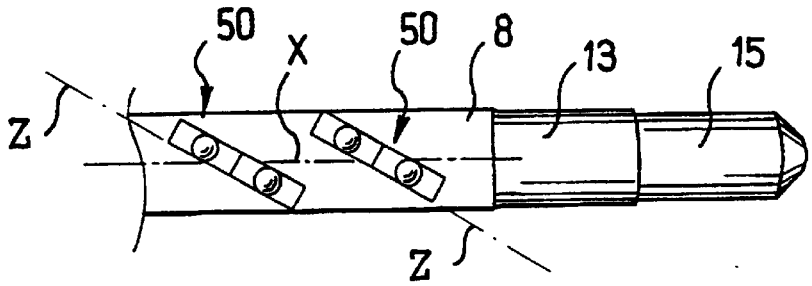
FIGS. 5–7 are views similar to FIG. 4 showing alternative configurations for arranging the teeth on the support.

The rows 50 may optionally not overlap when the application element is observed from the side, for example in the embodiment shown in FIG. 5.

Figure 6:
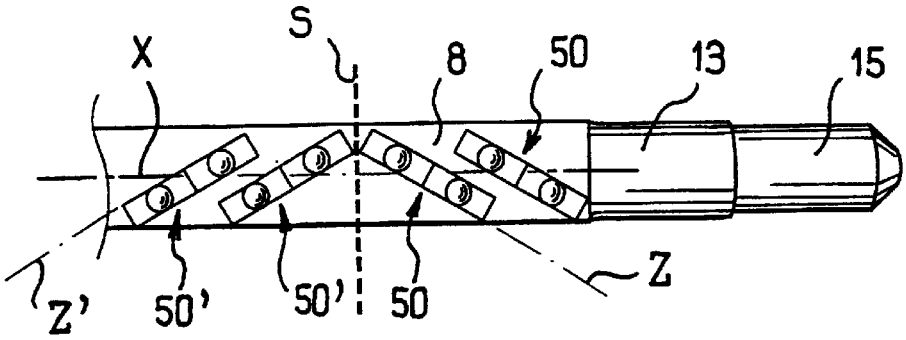

The application element 3 may be provided with rows or groups of rows 50 and 50' having respective angular positions Z and Z' that are different from each other. In the example shown in FIG. 6, the axes Z and Z' of the rows 50 and 50' form the same nonzero acute angle with the axis X, in absolute terms, but have configurations that are symmetrical about a plane of symmetry S perpendicular to the axis X.

Each row may have any number of teeth and this number may differ from one row to another.

Figure 7:
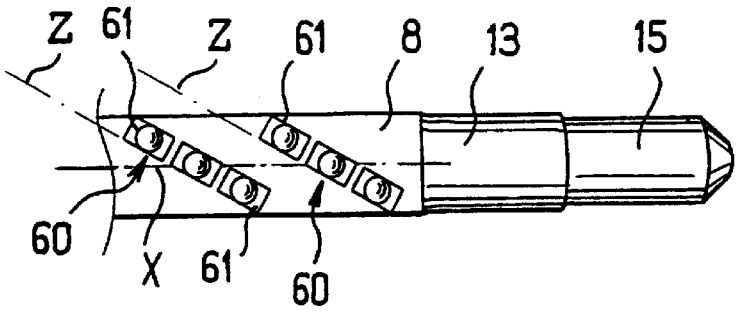

FIG. 7 shows an example of an application element provided with rows 60, each of which has three teeth 61. The teeth 61 may be substantially identical to the teeth 51 described above, but their bases are not mutually touching.

The teeth may have different shapes within the same row. In particular, it is possible to change the shape of the teeth, by using, for example, an applicator element having teeth of differing shapes and/or teeth and bristles.

Figure 8:
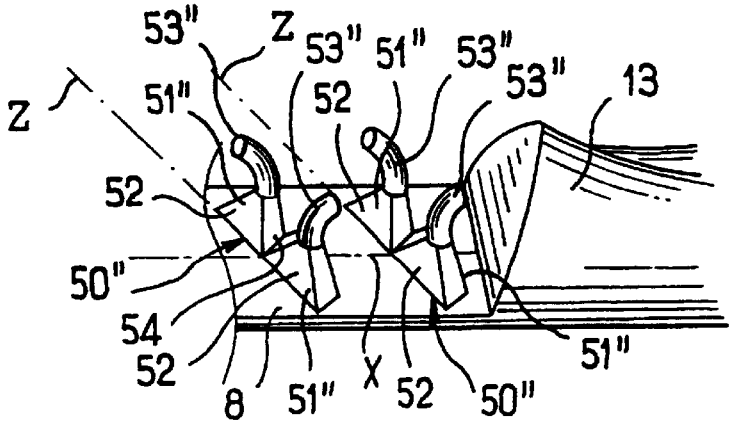
FIG. 8 is a view similar to FIG. 3 showing an alternative embodiment.

By way of example, FIG. 8 shows an applicator element having rows 50" of teeth 51". This application element differs from the application element described with reference to FIG. 3 by the fact that the teeth 51" are provided with end portions 53" that are curved. Within the same row 50", the end portions 53" may be curved in opposite directions.

Figure 9:
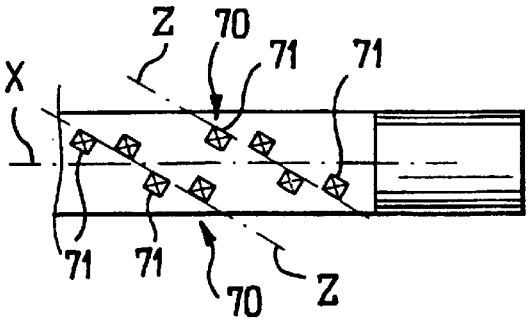
FIG. 9 is a plan view of another alternative embodiment including teeth disposed in a staggered manner in each row.

The teeth may also have bases that are not strictly aligned within the same row, and the row may, for example, be made up of teeth whose bases are disposed in a staggered configuration about the axis of the row, as shown in the plan view of FIG. 9. The teeth 71 of FIG. 9 have bases that are not mutually touching within each row 70, and that are of square cross-section. The spacing between the rows 70 may be larger than the spacing between the teeth 71 within each row 70.

The spacing between the bases of the teeth within the same row may vary, as may the spacing between the various rows.

Figure 10:
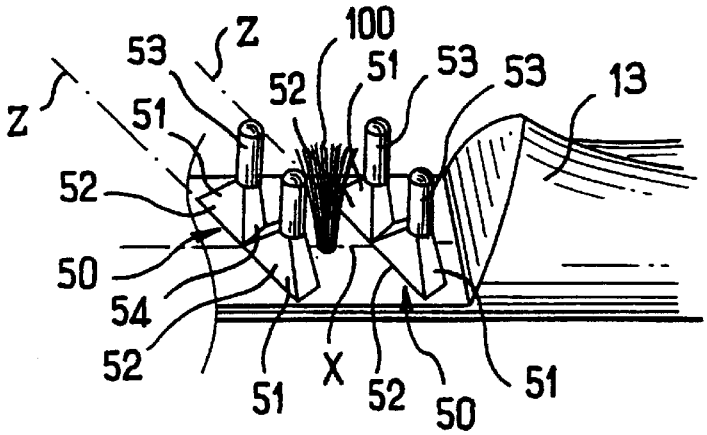
FIG. 10 is a view analogous to FIG. 3, showing a tuft of bristles mounted on the support.

The application element may further be provided with tufts of bristles between the rows of teeth, as shown in FIG. 10. The application element of FIG. 10 differs from the application element shown in FIG. 7 by the fact that it is provided with respective tuft of bristles 100 between consecutive rows 50.

Figure 11:
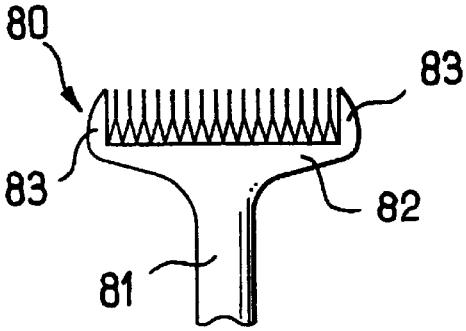
FIG. 11 is a view of another alternative embodiment of the applicator.

In the embodiment shown in FIG. 1, the teeth extend from the application element between the front and rear end portions of the application element, and the rear end portion of the application element may be connected to the stem. Alternatively, as shown in FIG. 11, the support may be arranged so that a longitudinal axis of the support is substantially non-parallel (e.g., perpendicular) to the stem so that teeth are arranged between side portions of the application element. In the example of FIG. 11, a flat stem 81 is connected to an application element 80 including a support 82 whose longitudinal axis 82 is perpendicular to the longitudinal axis of the stem 81. The support 82 is provided with side portions 83 between which one or more rows of teeth according to the invention are disposed, e.g., rows of teeth identical to the rows of teeth 51 described above.

Figure 12:
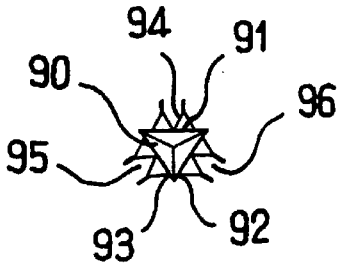
FIG. 12 is a front end view of an application element including a support having a polygonal cross-section.

In cross-section, i.e., perpendicularly to the axis X, the support may be circular, elliptical, polygonal, or otherwise. By way of example, FIG. 12 shows a support 90 having a cross-section that is triangular. The support 90 has three plane faces 91, 92, and 93, to which respective rows of teeth 94, 95, 96 are connected. Each of the rows of teeth may be made up of two teeth having oblong bases, and the axis of each row of teeth may be not perpendicular to the longitudinal axis of the support 90.

As shown in FIG. 12, the front portion of the support 90 may taper so as to make it easier for the support 90 to be inserted through the wiper member 7.

Figure 13:
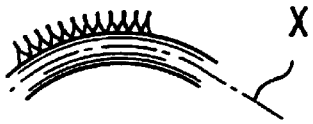
FIG. 13 is a side view showing an alternative embodiment including a curved support with a row of teeth on a convex face of the support.
Figure 14:
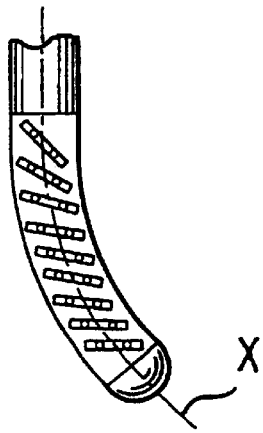
FIG. 14 is a plan view of an embodiment of an application element including a curved support.

FIGS. 13 and 14 show examples wherein the support may be curved. FIG. 13 shows an example wherein the face of the support to which the teeth are connected may be outwardly convex, so as to make it easier for the eyelashes to engage between the teeth. FIG. 14 shows an example wherein the longitudinal axis X of the support may also be curved, while the teeth are connected to a substantially plane face of the support.

The invention is not restricted to the embodiments which have just been described. For example, there are many different types of teeth that could be provided on the applicator. In particular it is possible to change the shape and configuration of the teeth, e.g. by using teeth of differing shapes and/or teeth and tufts, within the same application element. The teeth may have shapes other than those shown in the drawings and the teeth need not have the same shape as each other. The teeth may also have flocking.

In general, the particular features of each of the embodiments described may be combined, according to the type of product to be applied and the application effect desired.

The overall height of the teeth may be uniform, or the height of at least some teeth may differ from the height of at least some other teeth.

The overall length of the portion of the support on which the teeth are arranged may range from about 10 mm to about 45 mm, or from about 15 mm to about 28 mm. Another optional range for the overall length is from about 20 mm to about 26 mm.

As mentioned above, the invention is not limited to an application element having rows of teeth configured in the form of a comb, but also includes application elements including a number of rows of teeth, essentially forming either a comb or a brush, for example.

The application element may be substantially flexible, allowing it to bend as the product is being applied. When the surface of the support on which the teeth are disposed is convex, as shown in FIG. 13, the convex configuration may cause adjacent teeth to diverge away from each other, thus allowing a relatively large amount of product to be contained between adjacent teeth and consecutive teeth. Moreover, such an arrangement may achieve improved loading of the teeth with product as the application element is withdrawn through a wiper. This is because the force of the wiper on the application element may tend to straighten the axis of the application element and cause the teeth to move toward each other, particularly toward a middle portion (along the length) of the application element. As the teeth move toward each other, product may be forced between the teeth toward the base portion, again allowing the application element to hold a relatively large amount of product.

The application element may include a succession of teeth including a first and a second series of teeth which alternate, the teeth of the first series having a different shape, than the teeth of the second series. One of the series of teeth may itself be made up of teeth with differing shapes or even differing heights.

The teeth may have a height varying according to the axial position along the application element, for example, a height which increases, decreases, decreases then increases, or increases then decreases from one end of the application element to the other.

The teeth may have a surface condition that increases the amount of product with which the application element becomes laden. For instance, the teeth and/or the support may include capillary grooves or flocking, over all or parts of their surface.

The teeth may undergo a surface treatment by abrasion so as to form forks at the ends of the teeth, for example.

The teeth may undergo a heat treatment, for example, to round their tips or form a bubble at their free end. The teeth may thus become less aggressive toward the eyelashes.

The teeth and/or the support may be also coated with a gliding agent, such as a lacquer or Teflon, for example, to make them glide better along the eyelashes or, alternatively, to give them greater roughness. Such gliding agents may alternatively, or in addition be added to the material used to form the teeth.

The application element, or a portion thereof, such as the teeth, may also include active ingredients, such as preservatives, moisturizers, copper salts, magnetic particles, and other similar suitable materials, to be released into the product when the product is loaded onto the application element. These active ingredients can either be included in the material used to form the application element, or can be coated onto the application element, or both. In addition, products that modify the surface tension of the application element upon contact with moisture can be used to form the teeth or to coat the teeth.

The application element may be made by the injection-molding of plastic, but as an alternative, use may be made of methods for shaping material by compression, stamping or turning.

The support may include grooves or reliefs configured to hold the product.

The application element may include a part allowing it to be removably connected to the stem. As an alternative, the application element may be produced by molding plastic as a single piece with the applicator stem. The application element may have two substantially opposite ends and a portion located between the ends. One of the substantially opposite ends of the application element can be connected to a distal end portion of the stem, and a longitudinal axis of the application element may extend either at an angle to or substantially parallel to a longitudinal axis of the stem. Alternatively, the portion of the application element located between the two substantially opposite ends may be connected to a distal end portion of the stem, and the longitudinal axis of the application element may be substantially perpendicular to the longitudinal axis of the stem. The stem may be substantially flat.

The stem may include a connector at a distal end portion and the application element may be engageable with the connector. For example, the connector could define a slot configured to receive the application element.

It will be apparent to those skilled in the art that various modifications and variations can be made to the structure and methodology of the present invention. Thus, it should be understood that the invention is not limited to the embodiments and examples discussed in the specification. Rather, the present invention is intended to cover modifications and variations.

What is claimed is:

1. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein teeth extend from only one side portion of the application element.

2. The applicator of claim 1, wherein the distance between any pair of consecutive teeth of any of the at least two rows is less than the distance between the row including the pair and a row adjacent thereto.

3. The applicator of claim 1, wherein each of the teeth extending from the support is arranged in a row disposed transversely to the longitudinal axis of the support.

4. The applicator of claim 1, wherein an axis of at least one row forms a nonzero acute angle with the longitudinal axis of the support.

5. The applicator of claim 4, wherein the axis of each of the at least two rows forms a non-zero acute angle with the longitudinal axis of the support.

6. The applicator of claim 5, wherein the axis of each of the at least two rows forms substantially the same non-zero acute angle with the longitudinal axis of the support.

7. The applicator of claim 4, wherein the angle is less than or equal to about 45°.

8. The applicator of claim 7, wherein the base portions of each pair of consecutive teeth of each row contact one another.

9. The applicator of claim 1, wherein each of the teeth of the at least two rows includes a base portion, the base portion of at least one of the teeth of the at least two rows being oblong in cross-section.

10. The applicator of claim 9, wherein the base portion of each of the teeth of the at least two rows is oblong in cross-section.

11. The applicator of claim 1, wherein each of the at least two rows includes a first end and a second end, the first end being aligned along a first axis and the second end being aligned along a second axis, and wherein the first and second axes are parallel to the longitudinal axis of the support.

12. The applicator of claim 11, wherein the first and second axes are located on opposite sides of the longitudinal axis of the support.

13. The applicator of claim 1, wherein the at least two rows of teeth are disposed on the support such that a projection along an axis of the first row does not substantially overlap a projection along an axis of the second row.

14. An applicator system comprising:

the applicator of claim 1; and a receptacle configured to contain the product.

15. The system of claim 14, further comprising:

a wiper configured to remove excess product from the teeth when the applicator is removed from the receptacle.

16. The system of claim 15, wherein the wiper is deformable.

17. The system of claim 16, wherein the wiper is chosen from an elastomeric lip and a block of foam.

18. The system of claim 14, wherein the product is contained in the receptacle and the product is a cosmetic product for the eyelashes.

19. The system of claim 18, wherein the product is mascara.

20. The system of claim 14, wherein the receptacle includes an opening configured to permit passage of at least a part of the application element into the receptacle, and wherein the system further comprises a cap at another end of the stem, the cap being configured to sealably close the opening.

21. A method of applying a product to eyelashes, comprising:

providing the system of claim 14;

loading a product on at least some of the teeth; and placing at least some of the teeth in contact with the eyelashes such that the product coats the eyelashes.

22. The method of claim 21, wherein the receptacle contains the product, and wherein the loading includes inserting the applicator into the receptacle containing the product.

23. The method of claim 22, further comprising removing the applicator from the receptacle and wiping excess product from the teeth.

24. The method of claim 21, further comprising gripping the eyelashes between adjacent teeth.

25. The applicator of claim 1, wherein each of a plurality of the teeth has a tapered cross-section extending over at least a portion of the tooth height from adjacent the support toward a free end.

26. The applicator of claim 1, wherein at least some of the teeth have a free end portion having a shape chosen from cylindrical, substantially cylindrical, and curved.

27. The applicator of claim 1, wherein each of the teeth of the at least two rows includes a base portion, and wherein, within a row, the base portions of the teeth are arranged along an axis having a shape chosen from a substantially straight shape and a curved shape.

28. The applicator of claim 1, wherein the application element has a first end and a second end opposite to the first end, and wherein a number of the teeth between the first end and the second end ranges from about 20 to about 50.

29. The applicator of claim 1, wherein a height of each of the teeth in the at least two rows ranges from about 0.5 mm to about 10 mm.

30. The applicator of claim 1, wherein the support and the teeth are an integral, one-piece unit.

31. The applicator of claim 30, wherein the application element is formed by one of molding and die stamping.

32. The applicator of claim 31, wherein at least the teeth are formed of plastic material containing a gliding agent for improving gliding of hair on the teeth.

33. The applicator of claim 1, wherein at least the teeth comprise a gliding agent for improving gliding of the hair on the teeth, and wherein the gliding agent comprises a material chosen from polytetrafluoroethylene, graphite, silicones, molybdenum disulfide, and derivatives thereof.

34. The applicator of claim 1, wherein the application element is in the form of comb.

35. The applicator of claim 1, further comprising a stem, the application element being at an end of the stem.

36. The applicator of claim 35, wherein the stem extends from a handle element configured in the form of a closure cap for closing a receptacle.

37. The applicator of claim 35, wherein the application element is integrally molded with the stem.

38. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the at least two rows of teeth comprise a row having base portions offset in alternation, at least in part, on either side of a geometrical separation plane containing an axis of the offset row.

39. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the support has a polygonal cross-section in a plane perpendicular to the longitudinal axis of the support, and wherein each of the at least two rows of teeth are on a different main face of the support.

40. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein each of the teeth of the at least two rows includes a base portion, and wherein the base portions of at least one pair of consecutive teeth of at least one row contact one another.

41. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein at least one of a pair of consecutive teeth in one of the rows and a pair of adjacent teeth from a pair of adjacent rows are mutually overlapping when the application element is observed from the side, in a direction perpendicular to the longitudinal axis of the support.

42. The applicator of claim 41, wherein the pair of consecutive teeth in one of the rows are mutually overlapping when the application element is observed from the side, in a direction perpendicular to the longitudinal axis of the support.

43. The applicator of claim 41, wherein the pair of adjacent teeth of the pair of adjacent rows are mutually overlapping when the application element is observed from the side, in a direction perpendicular to the longitudinal axis of the support.

44. The applicator of claim 41, wherein the overlapping teeth form a substantially V-shaped notch therebetween, and wherein the notch is configured such that a hair is capable of being engaged therein.

45. The applicator of claim 44, wherein a bottom of the V-shaped notch is located at a non-zero distance from the support.

46. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the at least two rows of teeth comprise a first group of rows angularly positioned in a direction parallel to a first axis, and a second group of rows angularly positioned in a direction parallel to a second axis, the second axis not being substantially parallel to the first axis.

47. The applicator of claim 46, wherein the first and second axes are angularly positioned symmetrically relative to one other.

48. The applicator of claim 47, wherein the first and second axes are angularly positioned about a plane of symmetry perpendicular to the longitudinal axis of the support.

49. The applicator of claim 46, wherein the first group of rows is formed at a first end of the support and the second group of rows is formed at a second end of the support.

50. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein each of the teeth of the at least two rows includes a base portion having a rectangular cross-section, and wherein a long side of each rectangular cross-section is substantially parallel to an axis of the corresponding row.

51. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the applicator further comprises a tuft of bristles mounted on the support.

52. The applicator of claim 51, wherein the tuft of bristles is along one of the at least two rows of teeth.

53. The applicator of claim 51, wherein the tuft of bristles is between consecutive rows of teeth.

54. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the application element is formed of a material chosen from elastomer, metal, and alloy.

55. A method of applying a product to eyelashes, comprising:

providing a system comprising an applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, and wherein a pair of consecutive teeth of the first row of teeth are spaced apart by a second distance less than the first distance, and a receptacle configured to contain a product;

loading a product on at least some of the teeth; and placing at least some of the teeth in contact with the eyelashes such that the product coats the eyelashes, wherein the loading the teeth includes dispensing the product from the receptacle onto the teeth.

56. A method of applying a product to eyelashes, comprising:

providing a system comprising an applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, and wherein a pair of consecutive teeth of the first row of teeth are spaced apart by a second distance less than the first distance, and a receptacle configured to contain a product;

loading a product on at least some of the teeth; and placing at least some of the teeth in contact with the eyelashes such that the product coats the eyelashes, wherein the loading includes contacting the teeth with a solid cake of product.

57. The method of claim 56, further comprising moistening the solid cake of product.

58. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, wherein the further comprises a stem, the application element being at the end of the stem, and wherein the application element is formed of a plastic material more flexible than a plastic material used to form the stem.

59. A method of applying a product to eyelashes, comprising:

providing a system comprising an applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, and wherein a pair of consecutive teeth of the first row of teeth are spaced apart by a second distance less than the first distance, and a receptacle configured to contain a product;

loading a product on at least some of the teeth; and placing at least some of the teeth in contact with the eyelashes such that the product coats the eyelashes, wherein the product is mascara including fibers, and wherein the method further comprises orienting the fibers with the teeth such that the fibers are substantially parallel to the eyelashes as the product is applied.

60. A method of applying a product to eyelashes, comprising:

providing a system comprising an applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, and wherein a pair of consecutive teeth of the first row of teeth are spaced apart by a second distance less than the first distance, and a receptacle configured to contain a product;

loading a product on at least some of the teeth;

placing at least some of the teeth in contact with the eyelashes such that the product coats the eyelashes; and connecting the application element to the stem.

61. The method of claim 60, further comprising selecting the application element from a group of differing application elements.

62. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, wherein the further comprises a stem, the application element being at the end of the stem, and wherein the longitudinal axis of the support forms a non-zero angle with a longitudinal axis of the stem.

63. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the teeth in at least one of the rows comprise teeth extending in the same direction.

64. The applicator of claim 63, further comprising a stem, the application element being at an end of the stem, wherein the stem extends from a handle element configured in the form of a closure cap for closing a receptacle.

65. An applicator system comprising:

the applicator of claim 63;

a receptacle; and a cosmetic product contained in the receptacle, wherein the product is a product for at least one of the eyelashes and eyebrows.

66. The system of claim 65, wherein the product is mascara.

67. A method of applying product, comprising:

providing the system of claim 65;

loading a product on at least some of the teeth; and placing at least some of the teeth in contact with at least one of the eyelashes and eyebrows so as to apply the product thereto.

68. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the support comprises a substantially planar surface and wherein the teeth comprise teeth extending from the substantially planar surface.

69. The applicator of claim 68, further comprising a stem, the application element being at an end of the stem, wherein the stem extends from a handle element configured in the form of a closure cap for closing a receptacle.

70. An applicator system comprising:

the applicator of claim 68;

a receptacle; and a cosmetic product contained in the receptacle, wherein the product is a product for at least one of the eyelashes and eyebrows.

71. The system of claim 70, wherein the product is mascara.

72. A method of applying product, comprising:

providing the system of claim 70;

loading a product on at least some of the teeth; and placing at least some of the teeth in contact with at least one of the eyelashes and eyebrows so as to apply the product thereto.

73. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein an axis of at least one of the rows of teeth is rectilinear.

74. The applicator of claim 73, further comprising a stem, the application element being at an end of the stem, wherein the stem extends from a handle element configured in the form of a closure cap for closing a receptacle.

75. An applicator system comprising:

the applicator of claim 73;

a receptacle; and a cosmetic product contained in the receptacle, wherein the product is a product for at least one of the eyelashes and eyebrows.

76. The system of claim 75, wherein the product is mascara.

77. A method of applying product, comprising:

providing the system of claim 75;

loading a product on at least some of the teeth; and placing at least some of the teeth in contact with at least one of the eyelashes and eyebrows so as to apply the product thereto.

78. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein at least one of the rows of teeth has no more than three teeth.

79. The applicator of claim 78, further comprising a stem, the application element being at an end of the stem, wherein the stem extends from a handle element configured in the form of a closure cap for closing a receptacle.

80. An applicator system comprising:

the applicator of claim 78;

a receptacle; and a cosmetic product contained in the receptacle, wherein the product is a product for at least one of the eyelashes and eyebrows.

81. A method of applying product, comprising:

providing the system of claim 80;

loading a product on at least some of the teeth; and placing at least some of the teeth in contact with at least one of the eyelashes and eyebrows so as to apply the product thereto.

82. The system of claim 78, wherein the product is mascara.

83. An applicator for applying a product to at least one of eyelashes and eyebrows, the applicator comprising:

an application element configured to apply a product to at least one of eyelashes and eyebrows, the application element comprising a support having a longitudinal axis, and at least two rows of teeth, the at least two rows of teeth being disposed transversely with respect to the longitudinal axis of the support, each of the at least two rows of teeth comprising at least two teeth extending from the support, wherein the at least two rows of teeth comprise a first row of teeth adjacent to a second row of teeth, the first row of teeth and the second row of teeth being spaced apart by a first distance, wherein a pair of consecutive teeth of the first row of teeth are spaced apart by a second distance less than the first distance, and wherein the rows of teeth extend a distance substantially less than an entire length of the support.

84. The applicator of claim 83, further comprising a stem, the application element being at an end of the stem, wherein the stem extends from a handle el configured in the form of a closure cap for closing a receptacle.

85. An applicator system comprising:

the applicator of claim 83;

a receptacle; and a cosmetic product contained in the receptacle, wherein the product is a for at least one of the eyelashes and eyebrows.

86. The system of claim 85, wherein the product is mascara.

87. A method of applying product, comprising:

providing the system of claim 85;

loading a product on at least some of the teeth; and placing at least some of the teeth in contact with at least one of the eyelashes and eyebrows so as to apply the product thereto.

* * * * *

UNITED STATES PATENT AND TRADEMARK OFFICE

CERTIFICATE OF CORRECTION

PATENT NO. : 6,546,937 B2
DATED : April 15, 2003
INVENTOR(S) : Jean-Louis H. Gueret It is certified that error appears in the above-identified patent and that said Letters Patent is hereby corrected as shown below:

Column 11,
Line 5, please replace “nonzero” with -- non-zero --.
Line 15, please replace “claim 7” with -- claim 40 --.

Column 12,
Line 38, please replace “of comb” with -- of a comb --.

Column 16,
Line 62, before “further” please insert -- applicator --.

Column 18,
Line 10, before “further” please insert -- applicator --.

Column 20,
Line 61, please replace “el” with -- element --.

Column 21,
Line 5, please replace “a for” with -- a product for --.

Signed and Sealed this

Fifth Day of August, 2003

JAMES E. ROGAN
*Director of the United States Patent and Trademark Office*